US005598715A

United States Patent [19]

Edmisten

[11] Patent Number: 5,598,715

[45] Date of Patent: Feb. 4, 1997

[54] CENTRAL AIR HANDLING AND CONDITIONING APPARATUS INCLUDING BY-PASS DEHUMIDIFIER

[76] Inventor: John H. Edmisten, P.O. Box 2028, Boone, N.C. 28607

[21] Appl. No.: 485,729

[22] Filed: Jun. 7, 1995

[51] Int. Cl.[6] ..... F25B 49/00; G05D 21/00

[52] U.S. Cl. ..... 62/176.6; 62/180; 62/415; 236/44 C

[58] Field of Search ..... 62/90, 180, 176.5, 62/176.6, 173, 415, 93; 165/21; 126/113; 236/44 C

[56] References Cited

U.S. PATENT DOCUMENTS

| | | | |
|---|---|---|---|
| 1,819,643 | 8/1931 | Fleisher | 165/21 X |
| 2,048,137 | 7/1936 | Palmer | 165/21 X |
| 2,243,478 | 5/1941 | Knoy | 165/21 X |
| 2,255,292 | 9/1941 | Lincoln . | |
| 2,257,478 | 9/1941 | Newton | 165/21 X |
| 2,700,537 | 1/1955 | Pennington | 261/83 |
| 4,105,063 | 8/1978 | Bergt | 165/21 |
| 4,361,523 | 11/1982 | Shepherd | 126/113 X |
| 4,703,886 | 11/1987 | Kirby | 236/44 E |
| 5,088,295 | 2/1992 | Shapiro-Baruch | 62/196.4 |

*Primary Examiner*—William E. Wayner
*Attorney, Agent, or Firm*—Bell, Seltzer, Park & Gibson, P.A.

[57] ABSTRACT

A central air handling and conditioning apparatus is provided with a by-pass dehumidifier for maintaining the temperature of the air in a plurality of enclosed spaces within a predetermined range and the relative humidity of the air below a predetermined value. The apparatus includes an air conditioner for regulating the temperature of the air, a dehumidification means for regulating the relative humidity of the air and an air handler for circulating the conditioned and dehumidified air through the enclosed spaces. The air conditioner is a conventional forced-air furnace or heater, an air-conditioner, an evaporative cooler, or a fan or blower for heating or cooling the air and returning the air to the enclosed spaces. The dehumidification means is a modified dehumidifier for removing water vapor from the air. The air handler includes a conventional air circulation means which may be, for example, the blower of the air conditioner. A controller automatically controls the operation of the air circulation means and the air conditioner, and the air circulation means and the dehumidification means as required to maintain the temperature of the air within a predetermined range and the relative humidity of the air above a predetermined value.

10 Claims, 4 Drawing Sheets

CENTRAL AIR HANDLING AND CONDITIONING APPARATUS INCLUDING BY-PASS DEHUMIDIFIER

FIELD OF THE INVENTION

The present invention relates to a method and apparatus for conditioning and dehumidifying air, and more particularly to a central air handling and conditioning apparatus including a by-pass dehumidifier.

BACKGROUND OF THE INVENTION

For purposes of this specification, the term central air handling and conditioning apparatus refers to any system, such as a forced-air furnace or heater, air-conditioner, evaporative air cooler, fan or blower and the like or any combination thereof for circulating air in a plurality of enclosed spaces, such as different rooms in a building, and regulating the temperature of the air. The term dehumidifier refers to any apparatus for reducing the relative humidity of the air in an enclosed space by removing water vapor from the air and returning the dehumidified air to the enclosed space. Conditioned air is air which has been heated or cooled by a central air handling and conditioning apparatus. Dehumidified air is air which has been dehumidified by a dehumidifier. It has not previously been known to provide a central air handling and conditioning apparatus with a by-pass dehumidifier.

The temperature of the air in a plurality of enclosed spaces is often maintained within a predetermined range to provide comfort to the occupants. Regulating the temperature of the air alone, however, is not always sufficient to provide the desired degree of comfort. For example, although the temperature is within the desired range, the relative humidity may remain uncomfortably high. Typically, this situation occurs at higher elevations or near large bodies of water when the temperature at which water vapor begins to condense, or the dew point, is lower than the desired temperature. Thus, dehumidification by cooling is possible only by lowering the temperature of the conditioned air below the comfortable range.

As an alternative to additional cooling, a dehumidifier may be used to maintain the relative humidity of the air below a predetermined value. Separate air handling and conditioning apparatus and dehumidifiers are well known. It is also known to provide a single system which cools and dehumidifies, and which dehumidifies without cooling. Such a system is disclosed in U.S. Pat. No. 5,088,295 issued Feb. 18, 1992 to Shapiro-Baruch.

The patent to Shapiro-Baruch discloses an air conditioner with a dehumidification mode. The air conditioner operates on the conventional vapor compression principle, but includes a second inside heat exchanger and means for by-passing a portion of the flow of hot refrigerant through the second heat exchanger in the dehumidifying mode. A first inside heat exchanger acts as an evaporator to cool and dehumidify the air. The second heat exchanger is positioned in parallel with the first heat exchanger and acts as a heater to heat the air. By mixing the cooled and dehumidified air with the heated air, the conditioned air is dehumidified with little change in temperature. The Shapiro-Baruch air conditioner is particularly suited for room air conditioner applications. Thus, it is not readily adaptable to an existing central air handling and conditioning apparatus.

U.S. Pat. No. 2,255,292 issued Sep. 9, 1941, to Lincoln discloses a central air handling and conditioning apparatus. The Lincoln apparatus regulates the temperature and the relative humidity of the air within a plurality of rooms designed for human occupancy. A heat interchanger regulates the temperature of a fluid which is circulated through a radiator in each room. A fan or blower causes a flow of air to contact the radiator and thereby heat or cool the room. When the room is cooled in hot weather, an evaporator pan and drain collect the condensate which drips from the radiator into a central collector. The apparatus, however, does not include a by-pass dehumidifier. Thus, the Lincoln air handling and conditioning apparatus cannot dehumidify the air without further cooling the conditioned air.

SUMMARY OF THE INVENTION

In view of the noted deficiencies in the prior art, it is an object of the invention to provide a method and apparatus for handling, conditioning and dehumidifying air in a plurality of enclosed spaces.

It is another object of the invention to provide a method and apparatus for maintaining the temperature of the air in a plurality of enclosed spaces within a predetermined range.

It is another object of the invention to maintain the relative humidity of the air in a plurality of enclosed spaces below a predetermined value.

It is another object of the invention to provide a central air handling and conditioning apparatus including a by-pass dehumidifier.

It is another object of the invention to provide a central air handling and conditioning apparatus including a by-pass dehumidifier which dehumidifies without further cooling the air.

It is another object of the invention to provide a central air handling and conditioning apparatus including a by-pass dehumidifier which automatically regulates the temperature and the relative humidity of the air in a plurality of enclosed spaces, and circulates the conditioned and dehumidified air through the enclosed spaces.

It is another object of the invention to provide a method and apparatus for maintaining the relative humidity of the air in a plurality of enclosed spaces that can be easily integrated with an existing central air handling and conditioning apparatus.

The above and other objects and advantages of the invention are achieved in the preferred embodiments of the method and central air handling and conditioning apparatus illustrated and described herein.

The invention is a method and a central air handling and conditioning apparatus including a by-pass dehumidifier for maintaining the temperature of the air in a plurality of enclosed spaces within a predetermined range and the relative humidity of the air below a predetermined value. The apparatus includes an air handler for circulating the air through the plurality of enclosed spaces, an air conditioner for regulating the temperature of the air, and by-pass dehumidification means for regulating the relative humidity of the air.

The air handler may be any device for circulating air through a plurality of enclosed spaces. Preferably, the air handler includes an air supply duct, an air return duct and air circulation means disposed between the air supply duct and the air return duct. The circulation means of the air handler circulates the conditioned and dehumidified air to the enclosed spaces through the air supply duct and collects the air to be conditioned and dehumidified from the enclosed spaces through the air return duct. The circulation means is preferably a fan, or blower, of a conventional air conditioner. The air supply duct and air return duct are preferably the ductwork of a conventional heating, ventilation and air-conditioning (HVAC) system.

The air conditioner may be any device for regulating the temperature of the air in a plurality of enclosed spaces. Typically, the air conditioner maintains the temperature of the air in the enclosed spaces within a predetermined range to provide comfort to the occupants. Preferably, the air conditioner is selected from the group consisting of a conventional forced-air furnace or heater, an air-conditioner, an evaporative cooler, a fan or blower and the like, or any combination thereof.

The by-pass dehumidification means may be any device, including a conventional refrigeration system, for removing water vapor from the conditioned air and returning the dehumidified air to be circulated through the enclosed spaces. Typically, the dehumidification means maintains the relative humidity of the air in the spaces below a predetermined value. Preferably, the dehumidification means includes a modified dehumidifier, an inlet duct and an outlet duct. The dehumidifier includes a pair of heat exchangers in series and a compressor. The first heat exchanger operates as an evaporator to cool and dehumidify the air. The second heat exchanger operates as a heater to reheat the dehumidified air. The inlet duct extends between the air supply duct of the air handler and the dehumidifier. The outlet duct extends between the dehumidifier and the air return duct of the air handler.

In a preferred embodiment of the invention, the apparatus further includes a controller for automatically controlling the operation of the air handler, air conditioner and by-pass dehumidification means. The controller includes a thermostat, a humidistat and means for generating electrical signals in response to the ambient temperature and relative humidity of the air in the enclosed spaces. The thermostat and the humidistat monitor the ambient temperature and the relative humidity, respectively, of the air in the spaces. The signal generating means generates electrical signals which actuate the air handler and the air conditioner to regulate the temperature of (i.e., condition) the air, or which actuate the air handler and the dehumidification means to regulate the relative humidity of (i.e., dehumidify) the air.

In another preferred embodiment of the invention, the apparatus further includes a damper for selectively permitting the air circulated by the air handler to circulate through the dehumidifier. Preferably, the damper is located in the inlet duct of the dehumidification means adjacent the air supply duct of the air handler. The damper is movable between an open position which permits ambient or cooled air to circulate through the dehumidifier, and a closed position which prevents heated air from circulating through, and possibly damaging, the dehumidifier. The damper also regulates the amount of air which is permitted to circulate through the dehumidifier.

In yet another preferred embodiment of the invention, the apparatus further includes a freeze-stat control and a temperature limit switch. The freeze-stat control is preferably a bulb thermostat which is built into the evaporator of the dehumidifier. The freeze-stat control is electrically connected to a relay which deactivates the dehumidifier to prevent the evaporator from icing when cooled air is circulated through the dehumidification means. The temperature limit switch is attached to the dehumidifier adjacent the outlet duct. The temperature limit switch is electrically connected to the compressor of the dehumidifier to prevent the compressor from operating when heated air is circulated through the dehumidification means.

Thus, the invention provides a central air handling and conditioning apparatus including a by-pass dehumidifier to maintain the temperature of the air in a plurality of enclosed spaces within a predetermined range and the relative humidity of the air below a predetermined value. The air conditioner regulates the temperature of the air and the by-pass dehumidifier regulates the relative humidity of the air. The air handler circulates the air through the air conditioner, the dehumidification means and the enclosed spaces. A controller automatically monitors and actuates the air handler and the air conditioner to condition the air, or the air handler and the dehumidification means to dehumidify the air. Accordingly, the invention automatically regulates the temperature and the relative humidity of the air in a plurality of enclosed spaces to provide a desired degree of comfort for the occupants.

BRIEF DESCRIPTION OF THE DRAWINGS

The foregoing and other objects, advantages and features of the invention will become readily apparent in view of the following detailed description in conjunction with the accompanying drawings which illustrate preferred embodiments of the invention, and in which.

DETAILED DESCRIPTION OF THE PREFERRED EMBODIMENTS

Figure 1:
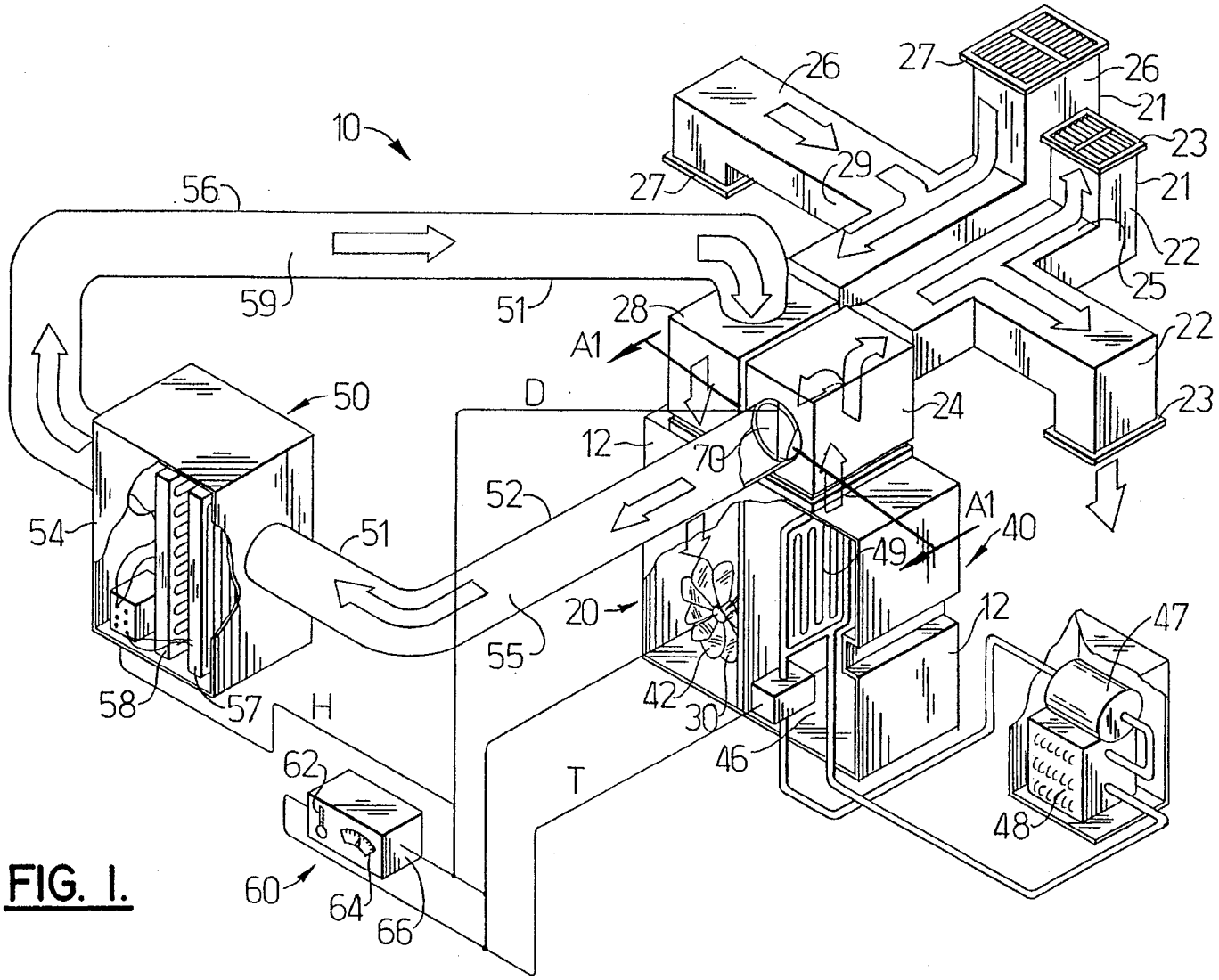
FIG. 1 is a perspective view of a central air handling and conditioning apparatus including a by-pass dehumidifier according to the invention.
Figure 2:
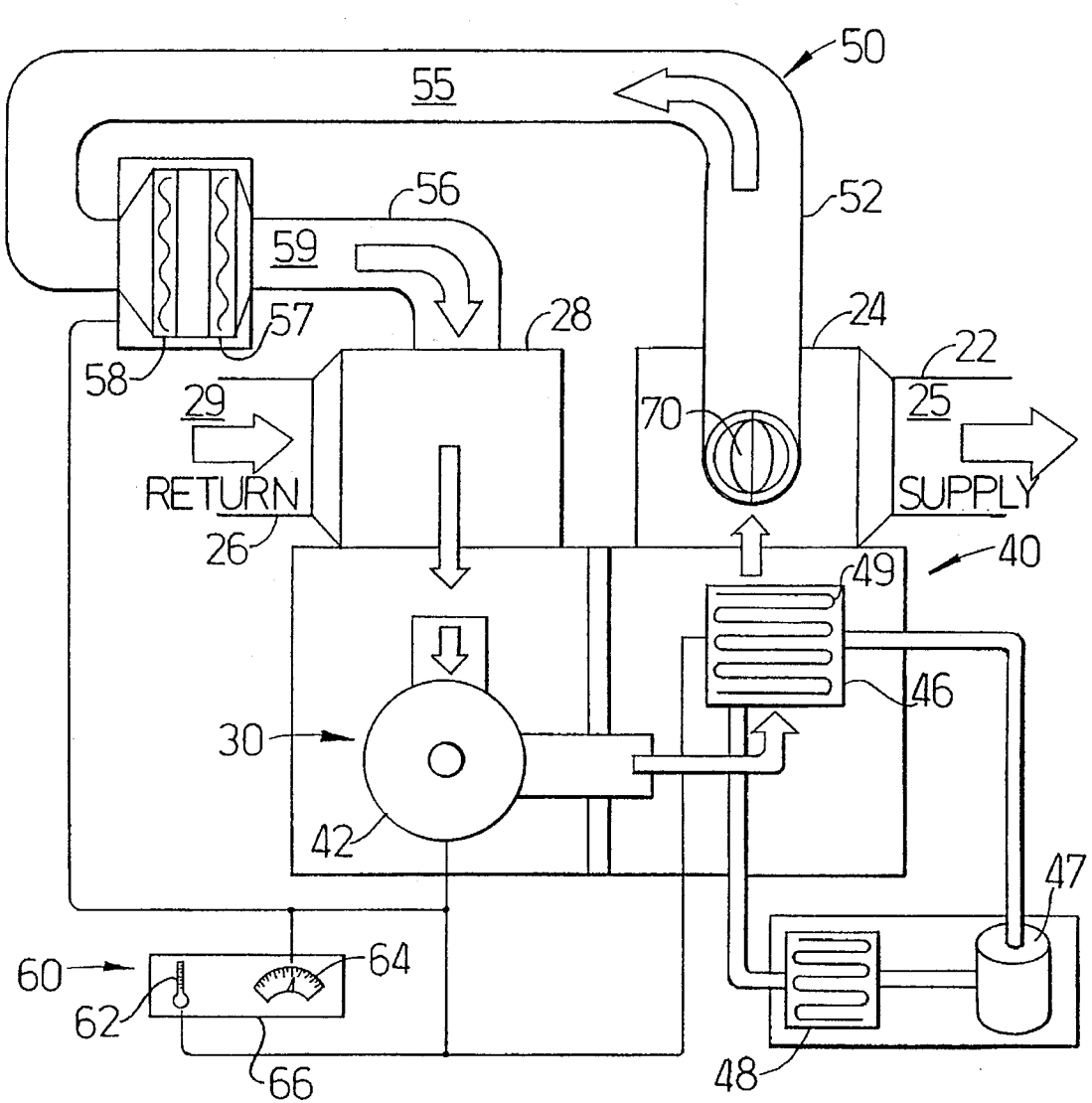
FIG. 2 is a schematic cross sectional elevation view illustrating the components of the air handling and conditioning apparatus of FIG. 1.
Figure 1A:
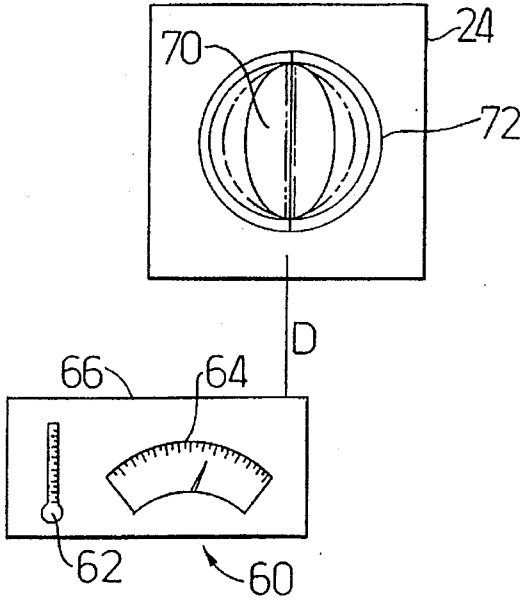
FIG. 1A is a detail view of a component of the air handling and conditioning apparatus of FIG. 1.

Referring to the accompanying drawings, FIGS. 1, 1A and 2 illustrate a preferred embodiment of a central air handling and conditioning apparatus including a by-pass dehumidifier, indicated generally at 10, for conditioning and dehumidifying the air in a plurality of enclosed spaces, such as the different rooms of a building. The apparatus 10 maintains the temperature of the air within a predetermined range and the relative humidity of the air below a predetermined value, and circulates the conditioned and dehumidified air through the enclosed spaces to provide comfort for the occupants. Apparatus 10 comprises an air handler 20 for circulating air through the enclosed spaces, an air conditioner 40 for regulating the temperature of the air and by-pass dehumidification means 50 for regulating the relative humidity of the air.

The air handler 20 may be any device for circulating air through a plurality of enclosed spaces, but preferably comprises an air supply duct 22, an air return duct 26 and air circulation means 30 disposed between the air supply duct and the air return duct. The air handler 20 may further comprise a supply air plenum 24 positioned between circulation means 30 and air supply duct 22, and a return air plenum 28 positioned between circulation means 30 and air return duct 26. The air within the supply air plenum 24 is maintained at a pressure greater than atmospheric such that the air in apparatus 10 flows through the air supply duct 22 in the direction of the enclosed spaces as indicated by the arrows. The air in return air plenum 26 is maintained at a pressure less than atmospheric such that the air in apparatus 10 flows through the air return duct 26 from the enclosed spaces as indicated by the arrows.

Air supply duct 22 and air return duct 26 comprise metal or plastic ductwork 21 of a conventional heating, ventilation and air-conditioning (HVAC) system. Ductwork 21 of air supply duct 22 extends between supply air plenum 24 and an air supply register 23 located in each enclosed space. Thus, air supply duct 22 defines a supply air passageway 25 such that the circulation means 30 is in fluid communication with each of the plurality of enclosed spaces. Ductwork 21 of air return duct 26 extends between an air return register 27 in each enclosed space and return air plenum 28. Thus, air return duct 26 defines a return air passageway 29 such that each of the plurality of enclosed spaces is in fluid communication with the circulation means 30.

Circulation means 30 of air handler 20 is disposed between the air supply duct 22 and the air return duct 26 within housing 12. The circulation means 30 may be any device for circulating conditioned and dehumidified air to the enclosed spaces through air supply duct 22 and collecting air to be conditioned and dehumidified from the enclosed spaces through air return duct 26. Preferably, the circulation means 30 is the fan, or blower, 42 of air conditioner 40.

Air conditioner 40 may be any device for maintaining the temperature of the air in the plurality of enclosed spaces within a predetermined range to provide comfort to the occupants. Preferably, the air conditioner 40 is selected from the group consisting of a conventional forced-air furnace or heater, an air-conditioner, an evaporative cooler, and a fan or blower. A forced-air furnace or heater increases the ambient temperature of the air in the enclosed spaces. An air-conditioner and an evaporative cooler reduce the ambient temperature of the air in the enclosed spaces. A fan or blower circulates the air in the enclosed spaces to cool the occupants by increasing the rate of evaporation on the surface of the skin.

For example, and not for purposes of limitation, air conditioner 40 may be a conventional vapor compression air-conditioner comprising a blower 44, heat exchanger 46, a compressor 47 and a condenser 48. Heat exchanger 46 acts in a known manner as an evaporator and comprises a hairpin coil 49 for conveying a flow of refrigerant. Air forced past heat exchanger 46 by blower 44 in the direction of air supply duct 22 is cooled and dehumidified. The vaporized refrigerant exiting heat exchanger 46 is routed to an external compressor 47 where the hot gas is compressed. The refrigerant is then cooled and condensed to a liquid again by external condenser 48 before being returned to heat exchanger 46. The conditioned and (partially) dehumidified air is circulated by circulation means 30 to the enclosed spaces through air supply duct 22.

The dehumidification means 50 may be any apparatus for maintaining the relative humidity of the air in the plurality of enclosed spaces below a predetermined value. Preferably, dehumidification means 50 comprises an inlet duct 52, a modified dehumidifier 54 and an outlet duct 56. Inlet duct 52 and outlet duct 56 comprise conventional metal or plastic ductwork 51. Ductwork 51 of inlet duct 52 extends between supply air plenum 24 adjacent air supply duct 22 and dehumidifier 54. Thus, inlet duct 52 defines a by-pass inlet passageway 55 such that circulation means 30 is in fluid communication with dehumidifier 54. Ductwork 51 of outlet duct 56 extends between dehumidifier 54 and return air plenum 28 adjacent air return duct 26. Thus, outlet duct 56 defines a by-pass outlet passageway 59 such that dehumidifier 54 is in fluid communication with circulation means 30.

The dehumidifier 54 is preferably a conventional dehumidifier that has been modified to remove the blower unit, the dehumidistat, and the dehumidifier controls. Dehumidifier 54 comprises a pair of heat exchangers arranged in series relation and a compressor. A first heat exchanger 57 acts in a known manner as an evaporator to cool and dehumidify the air. A second heat exchanger 58 acts in a known manner as a heater to reheat the dehumidified air. Air forced through inlet duct 52 and through first heat exchanger 57 by blower 42 is cooled and dehumidified. As the air is forced through second heat exchanger 58, it is heated such that the air exiting dehumidifier 54 through outlet duct 56 is dehumidified, but little changed in temperature. The dehumidified air is then circulated by circulation means 30 to the enclosed spaces through air supply duct 22.

In a preferred embodiment of the invention, the apparatus 10 further comprises a controller 60 for automatically controlling the operation of the air handler 20, air conditioner 40 and by-pass dehumidification means 50. Controller 60 comprises a thermostat 62, a humidistat 64 and means 66 for generating electrical signals in response to the temperature and relative humidity of the air in the enclosed spaces.

Figure 3:
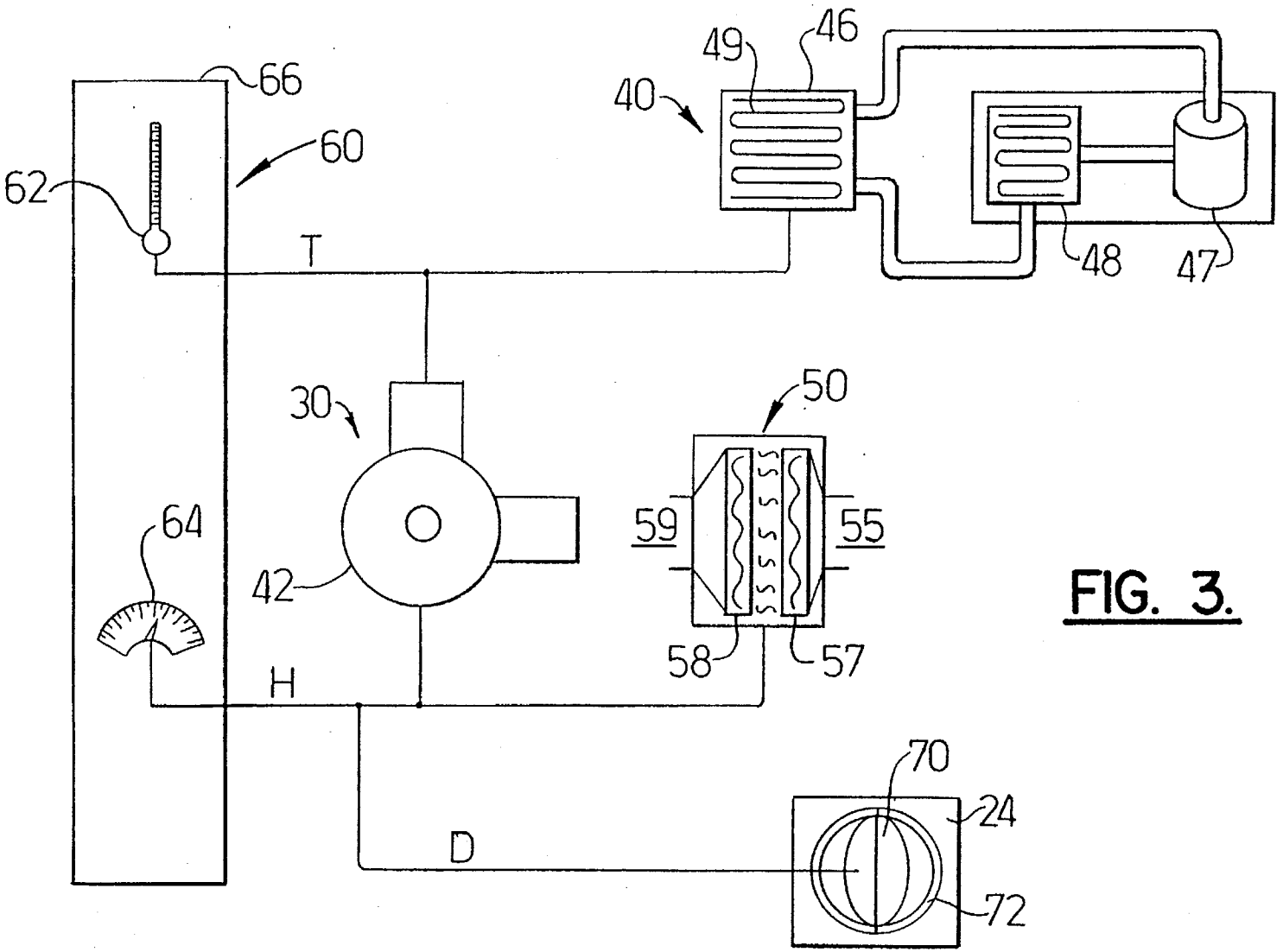
FIG. 3 is an electrical diagram of a control arrangement for automatically controlling the operation of the air handling and conditioning apparatus of FIG. 1.

As illustrated in the electrical diagram shown in FIG. 3, thermostat 62 monitors the temperature of the air in the enclosed spaces. If the ambient temperature of the air is not within the predetermined range, signal generating means 66 generates an electrical signal T which actuates circulation means 30 of air handler 20 and air conditioner 40 to circulate the ambient air and to regulate the temperature of the air, respectively. Signal generating means 66 continues to generate electrical signal T until thermostat 62 indicates that the ambient temperature is within the desired range.

The humidistat 64 monitors the relative humidity of the air in the enclosed spaces. If the ambient temperature of the air is within the predetermined range and the relative humidity is above the predetermined value, signal generating means 66 generates an electrical signal H which actuates circulation means 30 of air handler 20 and dehumidification means 50 to circulate the ambient air and to regulate the relative humidity of the air, respectively. Signal generating means 66 continues to generate electrical signal H until humidistat 64 indicates that the relative humidity is below the desired value.

In another preferred embodiment of the invention, the apparatus 10 further comprises a damper 70 for selectively permitting the air circulated by circulation means 30 of air handler 20 to circulate through dehumidifier 54. Preferably, damper 70 is located in inlet duct 52 of by-pass dehumidification means 50 adjacent air supply duct 22 of air handler 20. Damper 70 comprises a collar 72 for rotatably mounting the damper to supply air plenum 24 such that damper 70 is movable between an open position which permits ambient or cooled air to be circulated by circulation means 30 through dehumidifier 54 and a closed position which prevents heated air from being circulated through, and possibly damaging, the dehumidifier. The damper also regulates the amount of air which is circulated through the dehumidifier. The movement of damper 70 is automatically controlled by controller 66 such that when the ambient temperature of the air is within the predetermined range and the relative humidity is above the predetermined value, signal generating means 66 generates an electrical signal D to open damper 70.

In yet another preferred embodiment of the invention, the apparatus 10 further comprises a freeze-stat control (not shown) and a temperature limit switch (not shown). The freeze-stat control is preferably a bulb thermostat which is built into the first heat exchanger 57 of the dehumidifier. The freeze-stat control is electrically connected to a relay switch which deactivates the dehumidifier 54 to prevent the evaporator from icing when cooled air is circulated through the dehumidification means 50. The temperature limit switch is preferably attached to the dehumidifier 54 adjacent the opening of the outlet duct 56. The temperature limit switch is electrically connected to the compressor of the dehumidifier 54 to prevent the compressor from operating when heated air is circulated through the dehumidification means 50.

Figure 4:
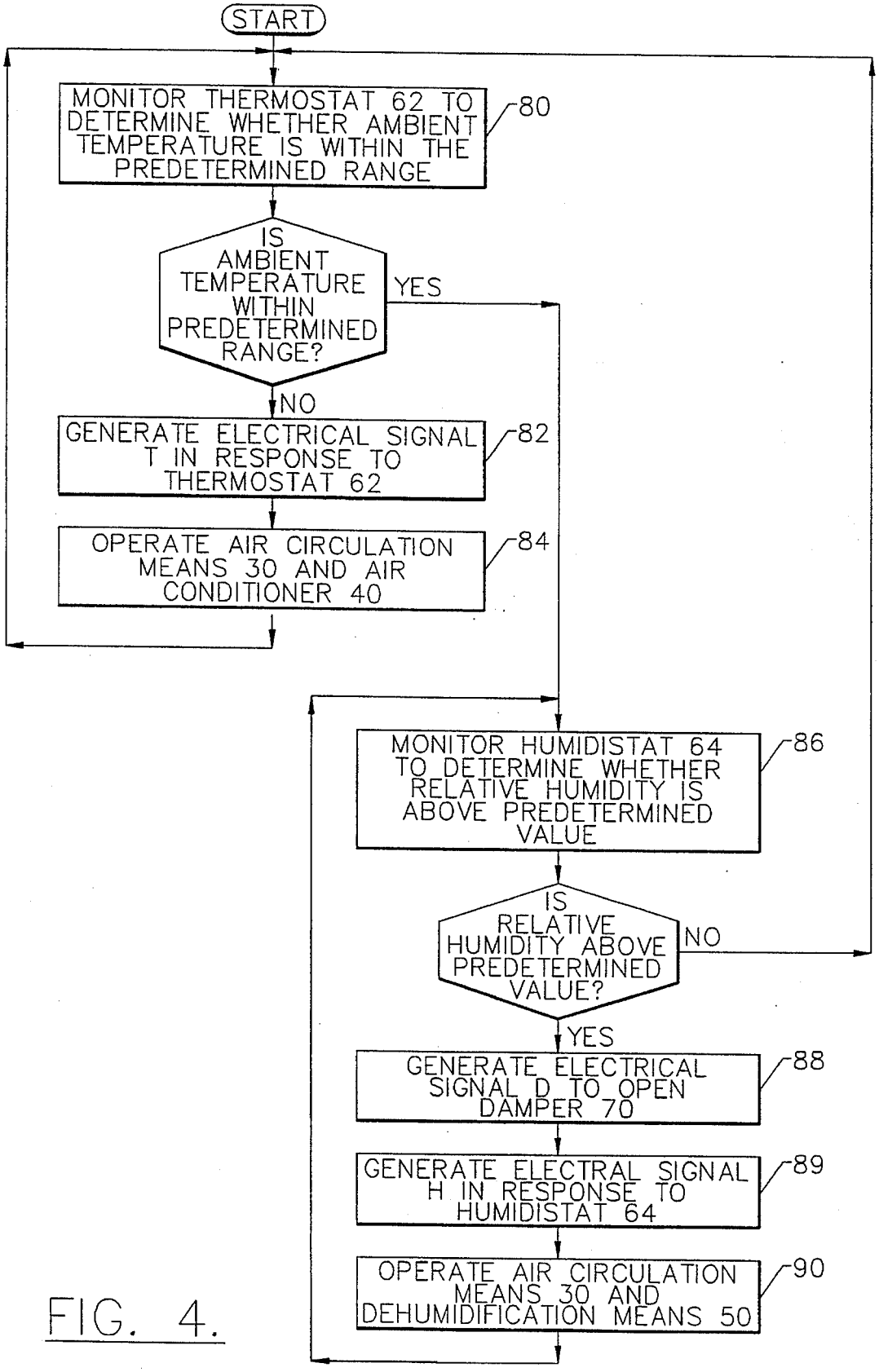
FIG. 4 is a flowchart illustrating a method for conditioning and dehumidifying air in a plurality of enclosed spaces according to the invention.

In the preferred embodiments described, the invention provides a method for maintaining the temperature of the air in a plurality of enclosed spaces within a predetermined range and the relative humidity of the air below a predetermined value. As illustrated by the steps shown in the flowchart of FIG. 4, the ambient temperature of the air in the enclosed spaces is monitored 80 by thermostat 62 of controller 60. If the ambient temperature is not within the predetermined range, signal generating means 66 generates 82 an electrical signal T which actuates circulation means 30 of air handler 20 and air conditioner 40 to operate 84 until the temperature is within the desired range.

The relative humidity of the air is monitored 86 by humidistat 64 of controller 60. If the relative humidity of the air is above the predetermined value (and the temperature of the air is within the predetermined range), signal generating means 66 generates 88 an electrical signal D which opens damper 70. The movement of damper 70 is automatically controlled by controller 60 to prevent air from being circulated through the dehumidification means 50 when dehumidifier 54 is not operating, and to regulate the amount of air circulated through dehumidification means 50 when dehumidifier 54 is operating. Signal generating means 66 also generates 89 an electrical signal H which actuates air circulation means 30 of air handler 20 and dehumidification means 50 to operate 90 until the relative humidity is below the predetermined value.

In the event that the controller 60 fails to close damper 70 to prevent air from circulating through dehumidification means 50 when dehumidifier 54 is not operating, a freeze-stat control and a temperature limit switch are provided to protect dehumidifier 54. The freeze-stat control senses the temperature of the air being circulated through the first heat exchanger (evaporator) 57 and provides an electrical signal to a relay switch to deactivate the dehumidifier 54 and thereby prevent the first heat exchanger from icing when cooled air is circulated through the dehumidification means 50. The temperature limit switch senses the temperature of the air being circulated through the second heat exchanger (heater) 58 and provides an electrical signal to a contact switch in the compressor circuit to deactivate the compressor and thereby protect dehumidifier 54 when heated air is circulated through the dehumidification means 50.

Accordingly, the apparatus and method of the invention automatically regulates the temperature and the relative humidity of the air in a plurality of enclosed spaces to provide a desired degree of comfort for the occupants. Obviously, many alternative embodiments of the invention are within the ordinary skill of those skilled in the art. Therefore, it is not intended that the invention be limited to the preceding description of illustrative preferred embodiments, but rather that all embodiments within the spirit and scope of the invention disclosed and claimed herein be included.

That which is claimed is:

1. An air handling and conditioning apparatus comprising:

an air handler comprising an air supply duct;

an air return duct; and air circulation means disposed between said air supply duct and said air return duct for circulating air through said air supply duct to a plurality of enclosed spaces and from the enclosed spaces through said air return duct;

an air conditioner disposed between said air supply duct and said air return duct for cooling the air passed therethrough by said air circulation means;

by-pass dehumidification means for maintaining the relative humidity of the air in the enclosed spaces below a predetermined value, said dehumidification means comprising a first heat exchanger for cooling and dehumidifying the air;

a second heat exchanger downstream of said first heat exchanger for reheating the air;

an inlet duct extending between said air supply duct and said first heat exchanger; and an outlet duct extending between said second heat exchanger and said air return duct, said air circulation means passing air through said dehumidification means at a substantially constant temperature; and control means for controlling the operation of said air circulation means, said air conditioner and said dehumidification means and operable in a first mode where only said air conditioner and said air circulation means operate to cool the air and a second mode where only said by-pass dehumidification means and said air circulation means operate to dehumidify the air.

2. The apparatus of claim 1 wherein said control means comprises a controller, a first sensor for sensing the temperature of the air in the enclosed spaces and a second sensor for sensing the relative humidity of the air in the enclosed spaces.

3. The apparatus of claim 2 wherein said first sensor comprises first signal generating means for generating a first electrical signal responsive to the temperature of the air in the enclosed spaces, and said second sensor comprises second signal generating means for generating a second electrical signal responsive to the relative humidity of the air.

4. The apparatus of claim 3 wherein the first electrical signal is provided to said controller to operate said air circulation means and said air conditioner and the second electrical signal is provided to said controller to operate said air circulation means and said dehumidification means.

5. The apparatus of claim 4 wherein said dehumidification means further comprises a damper movable between a closed position and an open position and located within said air inlet duct for permitting a portion of the air circulated by said air circulation means to circulate through said dehumidification means and wherein said controller further comprises third signal generating means for generating a third signal responsive to said second sensor.

6. The apparatus of claim 5 wherein said damper comprises a collar secured to the inside periphery of said inlet duct and a damper blade rotatably mounted to said collar.

7. The apparatus of claim 2 wherein said first sensor is a thermostat and wherein said second sensor is a humidistat.

8. The apparatus of claim 1 wherein said air handler further comprises:

a supply air plenum positioned between said air circulation means and said air supply duct, the pressure of the air within said supply air plenum being greater than atmospheric; and a return air plenum positioned between said air return duct and said air circulation means, the pressure of the air within said supply air plenum being less than atmospheric.

9. The apparatus of claim 1 wherein said air conditioner comprises a blower and wherein said air circulation means is said blower.

10. A central air handling and conditioning apparatus including a by-pass dehumidifier comprising:

an air handler comprising a supply air plenum;

an air supply duct extending outwardly from said supply air plenum to a plurality of enclosed spaces;

a return air plenum;

an air return duct extending inwardly from the enclosed spaces to said return air plenum; and air circulation means positioned between said supply air plenum and said return air plenum for circulating air through said air supply duct to the enclosed spaces and through said air return duct from the enclosed spaces;

by-pass dehumidification means for regulating the relative humidity of the air in the enclosed spaces and comprising a dehumidifier;

an inlet duct extending between said supply air plenum and said dehumidifier;

an outlet duct extending between said dehumidifier and said return air plenum; and a damper located within said inlet duct adjacent said supply air plenum, said damper being movable between a closed position for preventing the air circulated by said air circulation means from circulating through said dehumidifier and an open position for permitting circulation of the air through said dehumidifier; and external control means comprising a controller, a first sensor for sensing the temperature of the air in the enclosed spaces and providing a first electrical signal responsive to the temperature of the air to said controller; and a second sensor for sensing the relative humidity of the air in the enclosed spaces and providing a second electrical signal and a third electrical signal each responsive to the relative humidity of the air to said controller;

said control means for automatically controlling the operation of said air circulation means and said air conditioner in response to said first signal, and for automatically controlling the operation of said air circulation means and said dehumidification means in response to said second signal, and for automatically controlling the position of said damper in response to said third signal.

* * * * *